US006174147B1

(12) United States Patent
Tarutani et al.

(10) Patent No.: US 6,174,147 B1
(45) Date of Patent: Jan. 16, 2001

(54) REFRIGERANT COMPRESSOR WITH AN IMPROVED DISCHARGE VALVE ASSEMBLY

(75) Inventors: Tomoji Tarutani; Satoru Kuramoto; Norikazu Deto; Kuniyoshi Shirai, all of Kariya (JP)

(73) Assignee: Kabushiki Kaisha Toyoda Jidoshokki Seisakusho, Kariya (JP)

( * ) Notice: Under 35 U.S.C. 154(b), the term of this patent shall be extended for 0 days.

(21) Appl. No.: 09/244,183

(22) Filed: Feb. 4, 1999

(30) Foreign Application Priority Data

Feb. 20, 1998 (JP) ..... 10-039003

(51) Int. Cl.[7] ..... F04B 39/10; F04B 53/10

(52) U.S. Cl. ..... 417/569; 417/269; 417/571; 137/856

(58) Field of Search ..... 417/222.2, 269, 417/569, 539, 571, 270, 222; 137/512, 512.4, 856; 92/71

(56) References Cited

U.S. PATENT DOCUMENTS

| | | | | |
|---|---|---|---|---|
| 3,998,571 | * | 12/1976 | Falke | 417/569 |
| 4,226,572 | * | 10/1980 | Nakayama et al. | 417/269 |
| 4,431,378 | * | 2/1984 | Hattori et al. | 417/269 |
| 4,721,443 | * | 1/1988 | Allen | 417/539 |
| 4,886,424 | * | 12/1989 | Ikeda et al. | 417/269 |
| 5,022,833 | * | 6/1991 | Kandpal et al. | 417/571 |
| 5,100,306 | | 3/1992 | Moran, Jr. et al. | 417/571 |
| 5,226,796 | * | 7/1993 | Okamoto et al. | 417/571 |
| 5,286,173 | * | 2/1994 | Takenaka et al. | 417/571 |
| 5,379,799 | | 1/1995 | Kawai et al. | 137/856 |
| 5,417,552 | * | 5/1995 | Kayukawa et al. | 417/222.2 |
| 5,466,129 | * | 11/1995 | Fukai | 417/269 |
| 5,607,287 | * | 3/1997 | Ikeda et al. | 417/269 |
| 5,848,882 | * | 12/1998 | Hashimoto et al. | 417/569 |
| 6,048,178 | * | 4/2000 | Kawaguchi et al. | 417/269 |

FOREIGN PATENT DOCUMENTS

| | | |
|---|---|---|
| 42 26 587 A1 | 2/1993 | (DE) . |
| 195 46 490 A1 | 6/1996 | (DE) . |
| 0 595 313 | 5/1994 | (EP) . |
| 0 723 079 B1 | 7/1996 | (EP) . |
| 51-146410 | 11/1976 | (JP) . |
| 6-40389 | 5/1994 | (JP) . |

* cited by examiner

*Primary Examiner*—Teresa Walberg
*Assistant Examiner*—Leonid Fastovsky
(74) *Attorney, Agent, or Firm*—Woodcock Washburn Kurtz Mackiewicz & Norris LLP

(57) ABSTRACT

A refrigerant compressor, for compressing a refrigerant gas and delivering the compressed refrigerant gas toward an external refrigerating system, which has at least a rear housing provided with a rear discharge chamber defined by a partition wall and a rear discharge valve assembly including a rear discharge valve element and a rear retainer element coated with a rubber material, the partition wall having an endmost first end surface holding a base portion of the rear discharge valve element and a base end portion of the rear retainer element, a tapered surface portion extending toward a rear direction from the endmost first end surface, and a second end surface extending from the rear end of the tapered side surface to be parallel with the first end surface, the tapered surface portion and the second end surface defining a cavity and a support portion to prevent an uncontrolled deformation of controlling portions of the retainer element which control an amount of opening of the valve portions of the rear discharge valve element.

6 Claims, 3 Drawing Sheets

REFRIGERANT COMPRESSOR WITH AN IMPROVED DISCHARGE VALVE ASSEMBLY

BACKGROUND OF THE INVENTION

1. Field of the Invention

The present invention generally relates to a refrigerant compressor and, more specifically, to an improvement in a discharge valve and a retainer element assembly by which the physical durability of a discharge valve element of the refrigerant compressor may be surely improved.

2. Description of the Related Art

Many refrigerant compressors are known and one typical conventional compressor is a double-headed piston type swash-plate-operated refrigerant compressor as shown in FIG. 3.

Referring to FIG. 3, the conventional refrigerant compressor includes a front cylinder block 80 and a rear cylinder block 81 which are disposed in an end-to-end relation to form a combined cylinder block. A plurality of cylinder bores 80*a* and 81*a* for forming compression chambers are formed in the front cylinder block 80 and the rear cylinder block 81, respectively. Each pair of the cylinder bores 80*a* and 81*a* (a pair being one from each set of cylinder bores 80*a* and 81*a*) is coaxially aligned. A swash plate chamber 82 is formed in a middle part of the combined cylinder block. A front suction valve element 83 having a plurality of suction valves, a front valve plate 85, a front discharge valve element 87 having a plurality of suction valve portions and, a front retainer element 89 are placed on the front end of the front cylinder block 80. A rear suction valve element 84 having a plurality of suction valve portions, a rear valve plate 86, a discharge valve element 88 having a plurality of discharge valve portions and a rear retainer element 90 are placed on the rear end of the rear cylinder block 81. A front housing 91 and a rear housing 92 are joined to the front end of the front cylinder block 80 and the rear end of the rear cylinder block 81, respectively, and these four elements are combined together with a plurality of through screw bolts 93 to form a housing assembly of the compressor. O-rings are arranged between the front cylinder block 80 and the rear cylinder block 81, between the front cylinder block 80 and the front housing 91, and between the rear cylinder block 81 and the rear housing 92, respectively to hermetically seal the interior of the compressor against the external atmosphere. A drive shaft 94 is supported for rotation in the front housing 91, the front cylinder block 80 and the rear cylinder block 81 via bearings housed in the front and rear cylinder blocks 80 and 81. A swash plate 95 is mounted on the drive shaft 94 for rotation in the swash plate chamber 82 and is fixedly held in place on the drive shaft 94 by thrust bearings. A plurality of double-headed pistons 96 fitted in the cylinder bores 80*a* and 81*a* are linked to the swash plate 95 by shoes in contact with the front and the rear surface of the swash plate 95, respectively.

The rear housing 92 has a suction chamber 92*a* capable of communicating with an external evaporator (not shown) via the swash plate chamber 82, and a discharge chamber 92*b* capable of communicating with an external condenser (not shown). The suction chamber 92*a* and the discharge chamber 92*b* are defined by partition walls 92*c* and 92*d*. The rear valve plate 86 is provided with suction ports 86*a* connecting the suction chamber 92*a* and the cylinder bores 81*a* via the suction valves of the rear suction valve element 84, and discharge ports 86*b* connecting the discharge chamber 92*b* and the cylinder bores 81*a* via the discharge valve portions of the rear discharge valve element 88. The rear suction valve element 84 has a base portion held between the rear cylinder block 81 and the rear valve plate 86, and the suction valve portions extending from the base portion and capable of being elastically moved to open the suction ports 86*a* into the suction chamber 92*a*.

As shown in FIG. 4, the rear discharge valve element 88 has a base portion 88*a* held between the valve plate 86 and the rear housing 92, and the valve portions 88*b* extending from the base portion 88*a* and capable of being elastically moved to open the discharge ports 86*b* into the discharge chamber 92*b*. The retainer element 90 has a base end portion 90*a* in contact with the base portion 88*a* of the rear valve element 88 and controlling portions 90*b* extend from the base end 90*a* to control the opening of the respective valve portions 88*b* of the rear valve element 88. The respective controlling portions 90*b* are arranged to be in registration with the respective valve portions 88*b* of the rear valve element 88 and are curved into the interior of the discharge chamber 92*b*. The front and the rear surface of the retainer element 90 are coated with elastic layers (not shown) e.g., rubber layers or the like, so that the retainer element 90 may exhibit the function of gasket.

It should be noted that the front suction valve element 83, the front valve plate 85, the front discharge valve element 87, the front retainer element 89 and, the front housing 91 on the front end of the front cylinder block 80 are basically constructed using the same design principle as that of the above-described respective elements, i.e., the rear suction valve element 84, the rear valve plate 86, the rear discharge valve element 88, the rear retainer element 90 and the rear housing 92.

When the drive shaft 94 of the compressor is driven to rotate, the swash plate 95 drives the double headed pistons 96 to reciprocate in the cylinder bores 80*a* and 81*a*. Consequently, for example, on the rear side, a low-pressure refrigerant gas is sucked into the cylinder bores 81*a* from the suction chambers 92*a*, via the suction ports 86*a* and the valve portions of the rear suction valve element 84, and the refrigerant gas is compressed and discharged from the cylinder bores 81*a* into the discharge chamber 92*b* via the discharge port 86*b*, and the valve portions 88*b* of the rear discharge valve 88. The refrigerant gas is sucked into and discharged from the cylinder bores 80*a* on the front side in the same way.

In the compressor incorporating the foregoing front and rear discharge valve elements and front and rear retainer elements therein, it has been recently found that the valve portions of the respective discharge valve elements are unsatisfactory in physical or mechanical durability. Namely, as shown in FIG. 4, in the conventional typical refrigerant compressor, for example, the partition wall 92*c* of the rear housing 92 has a holding portion 92*d* arranged to come into contact with the base portion 90*a* of the retainer element 90 when assembled, and a relieved portion 92*e* formed as a large cut recessed from a plane including the holding portion 92*d* in the extending direction of the valve parts 88*b*. In the compressor, the base end portion 90*a* of the rear retainer element 90 is pressed by the holding portion 92*d* of the rear housing 92 due to a clamping force exhibited by the through screw bolts 93 (FIG. 2) to fixedly hold the base portions 88*a* of the rear discharge valve element 88 and the base end portions 90*a* of the retainer element 90 between the valve plate 86 and the rear housing 92.

In the described compressor, each relieved portion 92*e* is formed as a large cut recessed from a plane containing the holding portion 92*d*, and an edge 92*f* of the relieved portion

92*e* on the side of the valve portion 88*b* is spaced far from the back surface of the corresponding controlling portion 90*b* of the retainer element 90. Therefore, a large amount of deformation of each controlling portion 90*b* of the retainer element 90 easily occurs in the discharge chamber 92*b*, to take the shape indicated by the alternate long and two short dashes lines. The deformation of the controlling portion 90*b* of the retainer element 90 is specifically generated when the compressor operates in a liquid compression mode. Accordingly, there is a possibility that the valve portions 88*b* of the rear discharge valve element 88 are irregularly moved and twisted in the controlling portions 90*b* of the retainer element 90 to cause fatigue of the rear discharge element 90 and thus shortening the life of the rear discharge valve element 90.

Such a problem may be solved by an improvement in which the holding part 92*d* of the partition wall 92*c* of the rear housing 92 is formed to be in contact with the base end portion 90*a* of the retainer element 90, and a relieved portion 92*g* is formed to extend from the holding part 92*d* in a direction in which the valve portions 88*b* extends, while gradually receding to form a curved wall as shown in FIG. 5. In this connection, Japanese Unexamined Utility Model Publication (Kokai) No. 51-1436410 (JU-A-51-1436410) and U.S. Pat. No. 5,100,306 (U.S. Pat. No. 5,100,306) disclose compressors which include a discharge valve and retainer element assembly having a structure similar to the above-mentioned improvement in association with the discharge valves 88. Namely, as is understood from the illustration of FIG. 5, in the known compressors of JU-A-51-143641, and U.S. Pat. No. 5,100,306, the edge 92*h* of the relieved portion 92*g* arranged to be in registration with a portion of the valve portion 88*b* is not spaced far from the back surface of each control portion 90*b* of the retainer element 90, and hence the deformation of the control portion 90*b* of the retainer element 90 in the discharge chamber 92*b* during controlling of the opening of the discharge valve element 88 can be prevented.

Therefore, in the above-mentioned compressors, it is considered that the deterioration in the physical durability of all valve portions 88*b* of the discharge valve element 88 due to the deformation of the controlling portions 90*b* of the retainer element 90, that may occur during an opening control operation, can be prevented.

Nevertheless, the elastic layers of the retainer element 90 are easily compressed when the base end portions 90*a* of the retainer element 90 are pressed by the fastening force of through screw bolts (FIG. 3) or the like exerted thereon through the holding portions 92*d* of the rear housing 92 when assembling the compressor. Thus, the compressed elastic layers bulge out onto the relieved portions 92*g*. Since each relieved portion 92*g* of the partition wall 92*c* extends from the corresponding holding portion 92*d* in the extending direction of the valve portion 88*b* and recedes gradually in a curve, the relieved portion 92*b* is liable to press the control portion 90*b* of the retainer element 90. Therefore, a bending position (fulcrum) of each valve portion 88*b* of the discharge valve element 88 at which each valve portion 88*b* bends to perform an opening and a closing motion thereof must be shifted in the direction of extension of the valve portion 88*b* from a true fulcrum position. This shifting of the fulcrum of each valve portion 88*b* of the discharge valve element 88 is caused by not only a deterioration of the elastic layers of the retainer element 90 after a long period of use but also a possible damage to the elastic layers of the retainer element 90 during assembling the compressor. If each controlling portion 90*b* of the retainer element 90 is thus distorted, the elastic modulus of the valve portion 88*b* of the discharge valve element 88 increases to make it difficult to open the discharge port 86*b*, and an excessive bending stress is induced in all valve portions 88*b* of the discharge valve element 88 to reduce the operation life of the valve portions 88*b* by fatigue.

Further, JU-A-6-40389 and European Patent Publication No. 0595313B1 disclose a different discharge valve element and a retainer element assembly of a refrigerant compressor, in which a partition wall of a rear housing defining a discharge chamber is provided with a holding portion similar to the afore-mentioned holding portion of the rear housing 92, and the discharge chamber is used as a relieved portion for a retainer element. The retainer element is supported, at its back surface portions extending along valve portions of a discharge valve element, by a support wall of the rear housing in the shape of a projection portion projecting from a housing wall into the discharge chamber. Since the discharge chamber of the compressor serving as the relieved portion for the retainer element is recessed far from a plane in which the holding portion of the rear housing lies, the relieved portion does not include any portion exerting a pressure on the elastic layers of the retainer element when the base end portions of the retainer element are pressed by the above-mentioned holding portion. Thus, the controlling portions of the retainer element can be prevented from being deformed. Accordingly, a change in the elastic modulus of the valve portions of the discharge valve element and a deterioration in the physical durability of the valve portions of the discharge valve element can be surely prevented.

Further, in the above-described compressor, since the back surface of the retainer element is supported by the support wall (the projection portion) of the rear housing when the controlling portions of the retainer element control the opening of the valve portions, any deterioration in the physical durability of the valve portions of the discharge valve element due to the deformation of the controlling portions of the retainer element can be prevented.

Nevertheless, since the support wall or the projection portion of the rear housing of the above-described refrigerant compressor is formed separately from a partition wall defining the discharge chamber, an additional process to produce the support wall for supporting the controlling portions of the retainer element is required in addition to a process to produce the holding portion on the partition wall of the rear housing defining the discharge chamber. Thus, an increase in the production process of the rear housing eventually increases the manufacturing cost of the refrigerant compressor. Moreover, the support wall of the rear housing projecting into the discharge chamber may provide an obstruction to a flow of the refrigerant gas in the discharge chamber. Further, since the support wall of the rear housing necessarily causes a reduction in a volume of the discharge chamber, there is a possibility of causing a pulsation in a pressure of the compressed refrigerant gas when the compressed refrigerant gas is delivered from the discharge chamber toward an external refrigerating circuit.

The describe problems are encountered by all types of refrigerant compressors employing the above-described discharge valve element and retainer element assembly in addition to the double-headed piston type swash-plate-operated refrigerant compressor.

SUMMARY OF THE INVENTION

Therefore, an object of the present invention is to obviate all problems encountered by the conventional refrigerant compressors.

Another object of the present invention is to provide a refrigerant compressor incorporating, therein, an assembly of a discharge valve element and a retainer element which is improved so that a deterioration in a physical durability of a plurality of valve portions of the discharge valve element, due to an uncontrolled deformation of controlling portions of the retainer element when the controlling portions control the opening of the valve portions of the discharge valve element, can be prevented.

A further object of the present invention is to provide a refrigerant compressor incorporating an assembly of a discharge valve element and a retainer element which is improved so that a change in the elastic modulus and a deterioration in the physical durability of a plurality of valve portions of the discharge valve element due to an uncontrolled deformation of the controlling portions of the retainer element, resulting from a compression of the elastic layers when assembling the compressor, can be prevented.

A still further object of the present invention is to provide a refrigerant compressor incorporating therein an assembly of a discharge valve element and a retainer element which is improved so that the manufacturing cost of the compressor can be surely reduced.

A further object of the present invention is to provide a refrigerant compressor incorporating therein an assembly of a discharge valve element and a retainer element which enables a refrigerant gas to flow smoothly in the discharge chamber and to suppress pulsative motion of the refrigerant gas by providing the discharge chamber with a large volume.

In accordance with the present invention, there is provided a refrigerant compressor having a housing assembly incorporating therein a compressing unit for compressing a refrigerant gas in a compression chamber and for discharging the compressed refrigerant gas from the compression chamber into a discharge chamber, which comprises:

at least one discharge valve element having a base portion, and a plurality of valve portions, each extending from the base portion to be elastically moved to an opening position thereof providing a fluid communication between a discharge port opening to the compression chamber and the discharge chamber so that the refrigerant gas after compression is discharged from the compression chamber into the discharge chamber via the discharge port;

at least one retainer element having a base end portion in contact with the base portion of the discharge valve element, and a plurality of controlling portions to control a motion of opening of the valve portions of the discharge valve element, each of the plurality of controlling portions extending from the base end portion and having a portion curved relative to an extending direction of one of the valve portions while permitting one of the valve portions to be opened by a predetermined amount, the retainer element having front and rear surfaces coated with elastic layers, respectively; and a fixing unit including a holding portion for fixedly holding the base portion of the discharge valve element and the base end portion of the retainer element, a relieved portion arranged adjacent to the holding portion to be in registration with each of the valve portions of the discharge valve element and to prevent deformation of each of the controlling portions of the retainer element when the holding portion applies a holding force to the base end portion of the retainer element, and a support portion forming an edge portion arranged adjacent to an end portion of the relieved portion to prevent the deformation of each of the controlling portions when each of the controlling portions of the retainer element controls the opening of each of the valve portions of the discharge valve element.

Since the relieved portion is recessed from a plane including the holding portion holding the base end portion of the retainer element with respect to the extending direction of the valve portions, the elastic layers of the retainer element are not compressed when applying a holding force to the base end portion of the retainer element by the holding portions in assembling the refrigerant compressor and the deformation of the controlling portions of the retainer element can be prevented. Since the edge of the relieved portion of the fixing unit with respect to the extending direction of the valve portions of the discharge valve element are extended to function as a support portion in the compressor, the deformation of the controlling portions of the retainer element can be prevented when the controlling portions of the retainer element control the opening of the valve portions of the discharge valve element. Accordingly, any irregular movement of the valve portions of the discharge valve element attributable to the deformation of the controlling portions of the retainer element in controlling the opening of the valve portions of the discharge valve element can be prevented, and the change in the elastic modulus of the valve portions of the discharge valve element and the deformation of the valve portions, caused by a compression of the elastic layers when assembling the compressor, can be prevented.

Since the relieved portion is recessed from a plane including the holding portion with respect to the extending direction of the valve portions, and the edge of the relieved portion with respect to the extending direction of the valve portions of the discharge valve element functions as a support portion in the compressor, the holding portion, the relieved portion and the support portion are formed in a single fixing member by applying a series of machining process to the fixing member. Thus, the compressor per se can be eventually manufactured at a low cost.

The compressor of the present invention has the following means which exercises excellent actions and effects. If a housing has an axially projecting partition wall defining the discharge chamber, the partition wall has an endmost first end surface and a second end surface recessed from a plane including the first end surface. The first end surface functions as the holding portion, a cavity defined by the second end surface functions as the relieved portion, and an edge of the second end surface with respect to the extending direction of the valve portions functions as the support portion. The partition wall defines the fixing unit. Preferably, the partition wall is substantially annular, and the first and the second end surface extend along the partition wall and are substantially annular. The holding portion, the relieved portion and the support portion can be formed only by subjecting the partition wall of the housing to a series of processes and, consequently, the compressor can be manufactured at low cost. Since the discharge chamber is defined by the partition wall, the discharge chamber does not contain anything which may obstruct the flow of the refrigerant gas and has a large volume. Therefore, the refrigerant gas is able to flow smoothly through the discharge chamber, and the discharge chamber having a large volume suppresses pulsative refrigerant discharge.

BRIEF DESCRIPTION OF THE DRAWINGS

The above and other objects, features and advantages of the present invention will be made more apparent from the ensuing description of a preferred embodiment thereof with reference to the accompanying drawings wherein.

DESCRIPTION OF PREFERRED EMBODIMENTS

Figure 3:
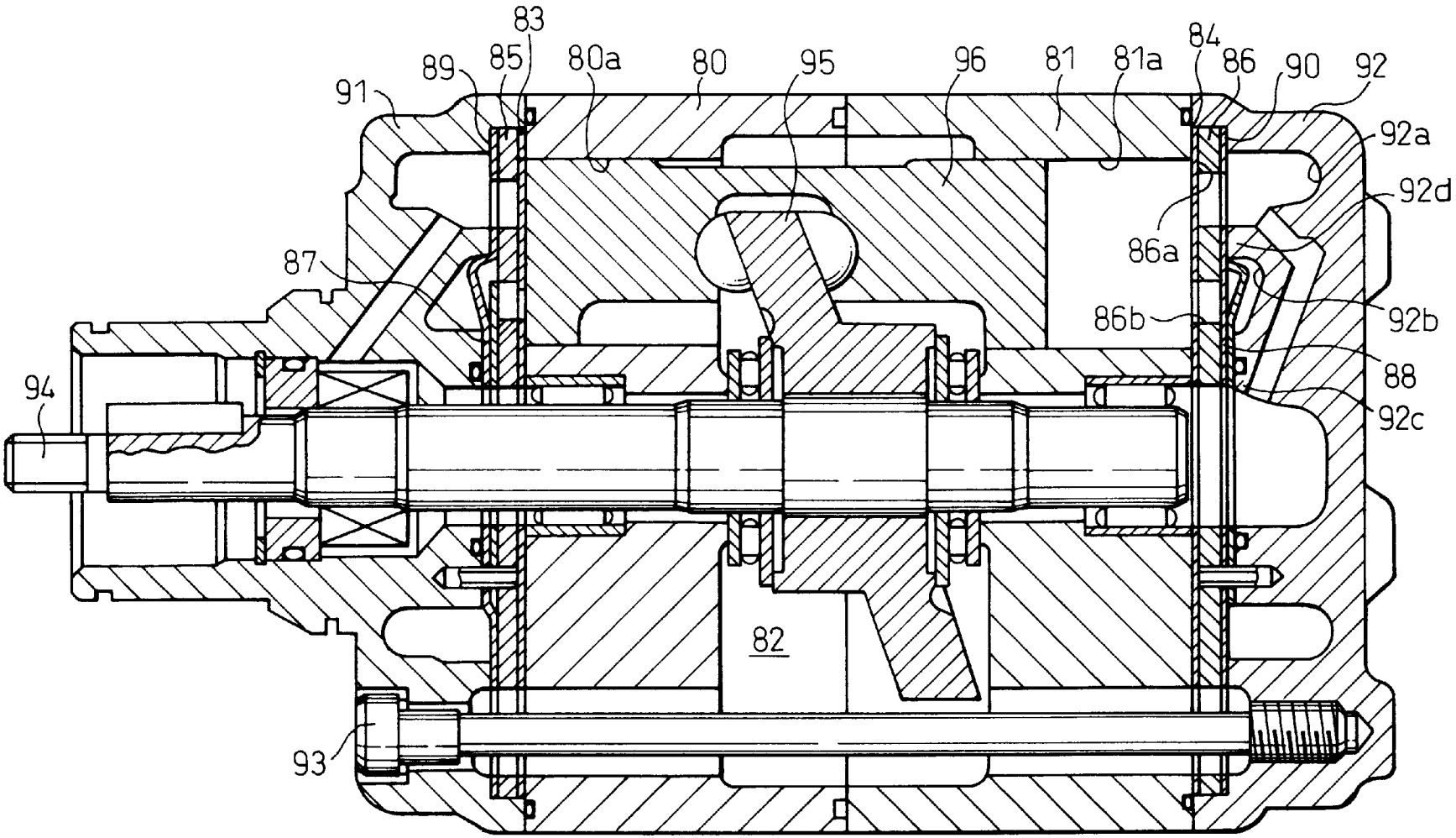
Fig.3 (PRIOR ART)
FIG. 3 is a longitudinal sectional view according to a prior art compressor.

Since a refrigerant compressor incorporating therein an assembly of a discharge valve element and a retainer element according the present invention is basically the same in general construction as the refrigerant compressor according to the prior art, shown in FIG. 3, elements and portions like or corresponding to those shown in FIG. 3 are designated by the same reference numerals and the description thereof will be omitted for brevity.

Figure 1:
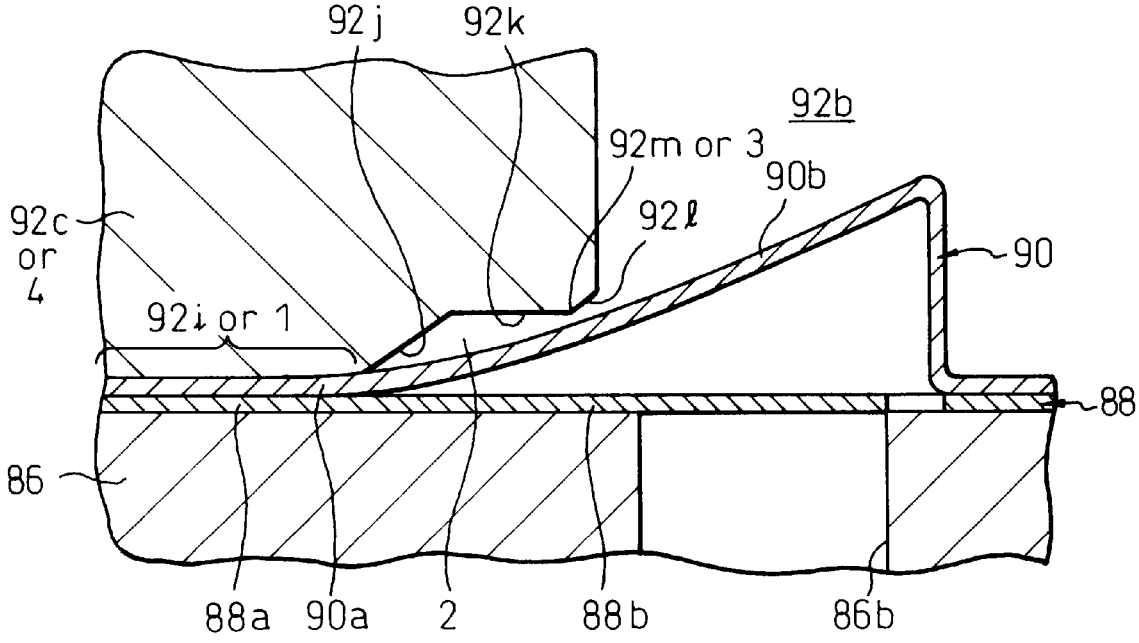
FIG. 1 is an enlarged sectional view of an essential portion of a compressor in a preferred embodiment according to the present invention.
Figure 2:
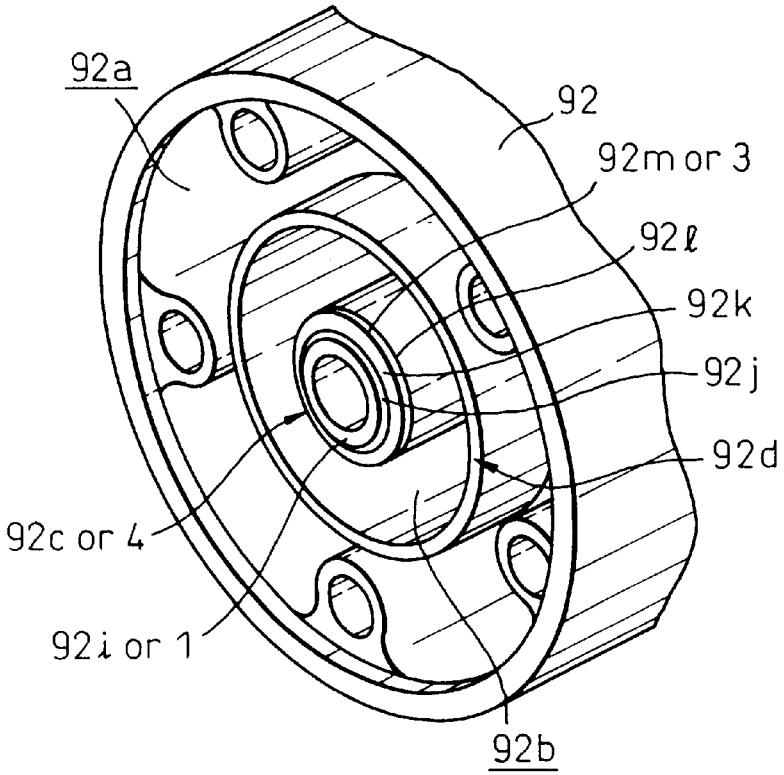
FIG. 2 is a perspective view of a rear housing included in the compressor embodying the present invention.

Referring to FIGS. 1 and 2, the refrigerant compressor has a rear housing 92 (refer also to FIG. 3) provided with a suction chamber (not shown) and a discharge chamber 92*b* defined by an axially projecting cylindrical partition wall 92*c*. The partition wall 92*c* has an endmost, annular first end surface 92*i*, a cylindrical tapered side surface 92*j* expanding from the first end surface 92*i* toward the rear (upward as viewed in FIG. 1), and an annular second end surface 92*k* extending from the rear end of the tapered side surface 92*j* in parallel with the first end surface 92*i* and recessed rearward from a plane including the first end surface 92*i*. The first end surface 92*i* functions as a holding portion 1 for holding a later-described assembly of a discharge valve element 88 and a retainer element 90, the tapered side surface 92*j* and the second end surface 92*k* define a cavity portion arranged adjacent to the discharge chamber 92*b* and functioning as a relieved portion 2.

The second end surface 92*k* has an edge formed as an chamfered face 92*l* at an inward position viewed in a direction corresponding to the direction in which each of a plurality of valve portions 88*b* of a discharge valve element 88 extends. A circularly extending boundary 92*m* between the second end surface 92*k* and the chamfered face 92*l* functions as a support portion 3 for a retainer element 90. The partition wall 92*c* functions as a fixing portion 4 to secure the assembly of the discharge valve element 88 and the retainer element 90 and a rear suction valve element 84 to a stationary element, i.e. a cylinder block via a valve plate 86. The identical constitution and arrangement may be also applicable to a front construction of the compressor which includes front suction valves 83, a front valve plate 85, a front discharge valve element 87, a retainer element 89 and a front housing 91.

In the refrigerant compressor, the first end surface 92*i*, the tapered side surface 92*j*, the second end surface 92*k* and the chamfered face 92*l* are formed by applying a series of machinings to the partition wall 92*c* of the rear housing 92 so that the above-mentioned holding portion 1, the relieved portion 2 and the support portion 3 are produced. During the machining process, the relieved part 2 is formed as a cavity recessed from a plane including the holding portion 1 and extending radially inwardly in a direction in which the valve portion 88*b* extends, and the support portion 3 is formed as an edge of the second end surface 92*k* arranged at a position adjacent to the inner end of the relieved part 2, viewed in a direction in which the valve portion 88*b* extends. Therefore, the production of the rear housing 92 of the refrigerant compressor can be easy to result in a reduction in the manufacturing cost of the entire compressor.

During assembling of the compressor, the base end portions 90a of the retainer element 90 are tightly sandwiched between the rear housing 92 and the valve plate 86 when the holding portion 1 of the rear housing 92 is pressed against the valve plate 86 by a fastening force applied by the through screw bolts (FIG. 2) in order to hold the base portions 88*a* of the discharge valve element 88 and the base end portions 90*a* of the retainer element 90.

Figure 5:
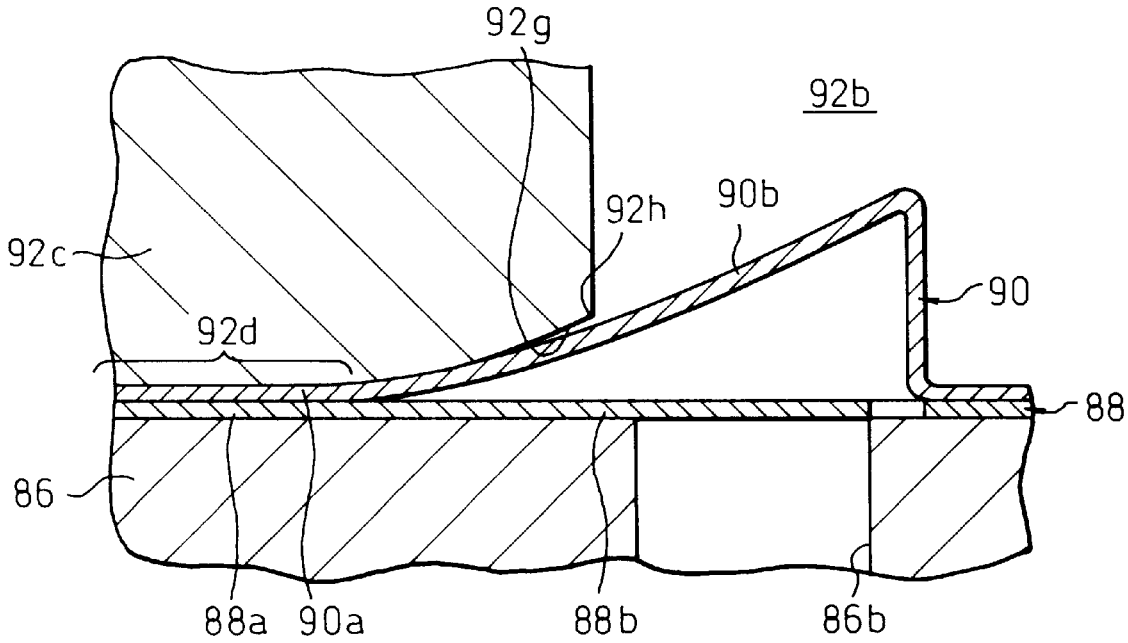
Fig.5 (PRIOR ART)
FIG. 5 is an enlarged sectional view of an essential portion of the prior art compressor.

Since the cylindrical tapered side surface 92*j* and the second annular end surface 92*k* of the partition wall 92*c* define the cavity-like relieved portion 2 recessed from a plane including the holding portion 1 and extending in the direction of extension of the valve portion 88*b*, no pressure is applied to the controlling portions 90*b* of the retainer element 90 and accordingly, an uncontrolled deformation of the controlling portions 90*b* can be prevented. As a result of experimental tests conducted by the present inventors, it was confirmed that the uncontrolled deformation of the controlling portions 90*b* of the retainer element 90 of the compressor according to the present invention, caused by the fastening force of the through screw bolts 93 is smaller by several tens of percent than that of the controlling portions of the retainer element incorporated in the refrigerant compressor of the prior art shown in FIG. 5.

Figure 4:
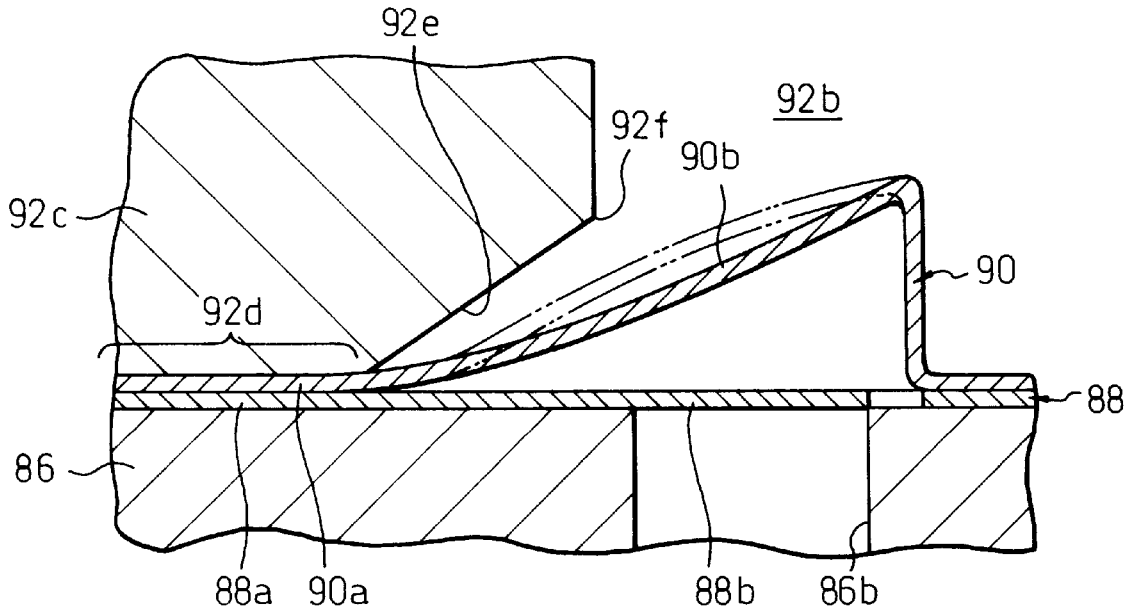
Fig.4 (PRIOR ART)
FIG. 4 is an enlarged sectional view of an essential portion of the prior art compressor.

In accordance with the present invention, since the support portion 3 is provided by the edge of the second annular end surface 92*k* which is arranged at a position adjacent to the radially inner end of the relieved portion 2, viewed in the direction of extension of the valve portions 88*b* of the discharge valve element 88, the support portion 3 can support the controlling portions 90*b* to surely prevent an uncontrolled deformation of the controlling portions 90*b* of the retainer element 90 when the same controlling portions 90*b* control the opening of the valve portions 88*b* of the discharge valve element 88. In accordance with experimental tests conducted by the present inventors, it was confirmed that even when the refrigerant compressor incorporating therein the discharge valve element and the retainer element assembly of the described embodiment of the present invention operates at a liquid compressing mode, the amount of any uncontrolled deformation of the controlling portions 90*b* of the retainer element 90 can be several tens of percent smaller than that of the prior art compressor shown in FIG. 4.

It should be understood that, in accordance with the present invention, the performance of a refrigerant compressor can be greatly improved. Namely, the deterioration in the physical durability of the valve portions 88*b* of the discharge valve element 88 due to the uncontrolled deformation of the controlling portions 90*b* of the retainer element 90 during the controlling of the opening of the valve portions 88*b* of the discharge valve element 88 can be prevented. Further, the change in the elastic modulus of the valve portions 88*b* of the discharge valve element 88 and the deterioration in the physical durability of the valve portions 88*b* due to an undesirable compression of the elastic coating layer of the retainer element 90 during the assembling of the refrigerant compressor can be surely prevented.

The sucking, compressing, and discharging operations of the refrigerant compressor incorporating therein the assembly of the discharge valve element and the retainer element according to the present invention are substantially the same as those of the compressor of the prior art shown in FIG. 3. In this connection, since the discharge chamber 92*b* has no obstructive member or portion therein, and since the partition wall 92*c*, which is a part of a chamber-defining means, is provided with all of the holding portion 1, the relieved portion 2, and the support portion 3 which contribute to an improved performance of the assembly of the valve element and the retainer element, the flow of the refrigerant is not obstructed and the discharge chamber 92*b* can have a large volume. Accordingly, the refrigerant gas can smoothly flow through the discharge chamber 92*b*, and the large volume of the discharge chamber is effective in suppressing pulsative refrigerant discharge.

The present invention is applicable not only to double-acting swash plate compressors like the embodiment specifically described herein, but also to all kinds of refrigerant compressors incorporating therein an assembly of a discharge valve element and a retainer element similar to the foregoing assembly of the discharge valve element 88 and the retainer element 90. The holding portion 1, the relieved portion 2 and the support portion 3 may be formed on another member instead of on the partition wall 92*c* of the rear housing 92. A continuous curved surface may be used instead of the relieved part 2 of the foregoing embodiment consisting of the tapered cylindrical side surface 92*j* and the second annular end surface 92*k*.

What we claim:

1. A refrigerant compressor having a housing assembly incorporating therein a compressing means for compressing a refrigerant gas in a compression chamber and for discharging the compressed refrigerant gas from the compression chamber into a discharge chamber comprising:

at least one discharge valve element having a base portion and a plurality of valve portions each extending from said base portion to be elastically moved to an opening position thereof providing a fluid communication between a discharge port opening to said compression chamber and said discharge chamber so that the refrigerant gas after compression is discharged from said compression chamber into said discharge chamber via said discharge port;

at least one retainer element having a base end portion in contact with said base portion of said discharge valve element and having a plurality of controlling portions to control a motion of opening of said valve portions of said discharge valve element, each of said plurality of controlling portions extending from said base end portion and having a portion curved relative to the extending direction of one of said valve portions while permitting said one of said valve portions to be opened by a predetermined amount, said retainer element having front and rear surfaces coated with elastic layers, respectively; and a fixing means including a holding portion for fixedly holding said base portion of said discharge valve element, and said base end portion of said retainer element, a relieved portion arranged adjacent to said holding portion to be in registration with each of said valve portions of said discharge valve element and to prevent deformation of each of said controlling portions of said retainer element when said holding portion applies a holding force to said base end portion of said retainer element, and a support portion forming an edge portion arranged adjacent to an end portion of said relieved portion, wherein said support portion contacts said sloping portion wherein said support portion contacts said sloping portion to prevent the deformation of each of said controlling portions when said each of said controlling portions of said retainer element controls the opening of said each of said valve portions.

2. The refrigerant compressor according to claim 1, wherein said housing assembly including a housing having an axially projecting partition wall defining said discharge chamber, said partition wall having an endmost first end surface and a second end surface recessed from a plane including said first end surface, said first end surface being formed as said holding portion, and said second end surface defining a cavity arranged adjacent to said discharge chamber and forming said relieved portion, said second end surface further having an edge at a position thereof arranged adjacent to an end of said relieved portion to form said support portion, said partition wall of said housing constituting said fixing member.

3. The refrigerant compressor according to claim 2, wherein said partition wall of said housing is formed as a substantially annularly extending wall, and said first and second end surfaces extend along said annularly extending wall of said partition wall.

4. A double-headed piston type refrigerant compressor comprising:

a housing assembly including an axial cylinder block having opposite front and rear ends and a plurality of axial cylinder bores, a front housing connected to said front end of said cylinder block via a front valve plate, and a rear housing connected to said rear end of said cylinder block;

a plurality of double-headed pistons received in said plurality of cylinder bores for being reciprocated therein to compress a refrigerant gas within said cylinder bores and to discharge the refrigerant gas after compression from said cylinder bores into front and rear refrigerant gas after compression from said cylinder bores into front and rear discharge chambers formed in said front and rear housing;

an axial drive shaft rotatably supported in said housing assembly;

a swash plate mounted on said drive shaft to be rotatable with said drive shaft to thereby drive reciprocation of said plurality of double-headed pistons;

at least a rear discharge valve element having a base portion, and a plurality of valve portions extending from said base portion to be elastically moved to an position thereof providing a fluid communication between a plurality of discharge ports formed in said rear valve plate to open toward said plurality of cylinder bores and said rear discharge chamber so that the refrigerant gas after compression is discharged from said respective cylinder bores into said rear discharge chamber via said discharge ports of said rear valve plate;

at least one rear retainer element having a base end portion in contact with said base portion of said rear discharge valve element, and a plurality of controlling portions to control a motion of opening of said valve portions of said rear discharge valve element, each of said plurality of controlling portions extending from said base end portion and having a sloping portion relative to an extending direction of one of said valve portions while permitting said one of said valve portions to be opened by a predetermined amount, said retainer elment having front and rear surfaces coated with elastic layers, repectively; and an axially projectiong partition wall formed in said rear housing and defining a fixing means including a holding portion for fixing said base portion of said rear discharge valve element and said base end portion of said rear retainer element to said rear valve plate, a relieved portion arranged adjacent to said holding portion to be in registration with each of said valve portions of said rear discharge valve element when said holding portion applies a holding force to said base end portion of said retainer element, and a support portion forming an edge portion arraged adjacent to an end portion of said relieved portion, wherein said support portion contacts said sloping portion to prevent the deformation of each of said controlling portions when said each of said controlling portions of said rear retainer element controls the opening of said each of said valve portions of said rear dischage valve element.

5. The double-headed piston type refrigerant compressor according to claim 4, wherein said partition wall of said rear housing is formed as a substantially annularly extending wall and has an endmost first end surface and a second end surface recessed from a plane including said first end surface, said first end surface being formed as said holding portion, and said second end surface defining a cavity arranged adjacent to said rear discharge chamber and forming said relieved portion, said second end surface further having an edge at a position thereof arranged adjacent to an end of said relieved portion to form said support portion.

6. The double-headed piston type refrigerant compressor according to claim 5, wherein said first and second end surfaces extend along said annularly extending wall of said partition wall.

* * * * *

UNITED STATES PATENT AND TRADEMARK OFFICE

CERTIFICATE OF CORRECTION

PATENT NO. : 6,174,147 B1
DATED : January 16, 2001
INVENTOR(S) : Tarutani et al.

It is certified that error appears in the above-identified patent and that said Letters Patent is hereby corrected as shown below:

Column 4,
Line 58, delete “describe” and insert therefor -- described --.

Column 9,
Line 50, delete “having a portion curved relative” and insert therefor -- having a sloping portion relative --.

Column 10,
Lines 1-2, delete “wherein said support portion contacts said sloping portion”.

Column 11,
Line 8, insert after the word “element” -- and to prevent deformation of each of said controlling portions of said rear element --.

Signed and Sealed this

Seventeenth Day of September, 2002

*Attest:*

*Attesting Officer*

JAMES E. ROGAN
*Director of the United States Patent and Trademark Office*